US007788832B2

(12) United States Patent
Yebenes De Madrid

(10) Patent No.: US 7,788,832 B2
(45) Date of Patent: Sep. 7, 2010

(54) SYSTEM FOR THE FORCED WAVING OF FLAGS FOR ADVERTISING DEVICES AND SIMILAR AND CORRESPONDING OPERATION METHODS

(76) Inventor: Gonzalo Yebenes De Madrid, Francisco Suarez, 21, Madrid (ES) 28036

( * ) Notice: Subject to any disclaimer, the term of this patent is extended or adjusted under 35 U.S.C. 154(b) by 233 days.

(21) Appl. No.: 11/886,650

(22) PCT Filed: Mar. 14, 2006

(86) PCT No.: PCT/ES2006/070034

§ 371 (c)(1),
(2), (4) Date: Sep. 17, 2007

(87) PCT Pub. No.: WO2006/097565

PCT Pub. Date: Sep. 21, 2006

(65) Prior Publication Data

US 2009/0019740 A1 Jan. 22, 2009

(30) Foreign Application Priority Data

Mar. 16, 2005 (ES) ..... 200500613

(51) Int. Cl.
*G09F 17/00* (2006.01)

(52) U.S. Cl. ..... 40/218; 116/173

(58) Field of Classification Search ..... 40/218, 40/422, 439; 116/173

See application file for complete search history.

(56) References Cited

U.S. PATENT DOCUMENTS

| | | | | |
|---|---|---|---|---|
| 5,398,638 | A * | 3/1995 | Bonk | 116/173 |
| 6,622,649 | B1 * | 9/2003 | Shaw | 116/173 |
| 7,017,510 | B1 * | 3/2006 | Nair | 116/173 |

FOREIGN PATENT DOCUMENTS

| | | |
|---|---|---|
| DE | 3939085 | 5/1991 |
| ES | 2026772 | 1/1992 |
| FR | 829663 | 4/1938 |

* cited by examiner

*Primary Examiner*—Lesley Morris
*Assistant Examiner*—Shin Kim
(74) *Attorney, Agent, or Firm*—Adams Intellectual Property Law

(57) ABSTRACT

The invention relates to a system for the forced waving of flags for advertising devices and similar and to the corresponding operation methods. The inventive system comprises a support (10) for supporting a flag or similar (2) with the aid of a flag-waving shaft (20) and for securing blowing means (11) which release forced air flows (S) that are applied to the flag or a similar element disposed on the waving shaft. The aforementioned blowing means (11) supply one or more laminar air flows (S) through the outlet(s) (110) thereof. The flag-waving shaft (20) is positioned perpendicularly to the direction of flow of the laminar air flow(s) on an external side of, and close to, the outlets of the blowing means, said zone containing flows with no turbulence.

24 Claims, 10 Drawing Sheets

SYSTEM FOR THE FORCED WAVING OF FLAGS FOR ADVERTISING DEVICES AND SIMILAR AND CORRESPONDING OPERATION METHODS

This application is a national stage application of International Application No. PCT/ES2006/070034 filed Mar. 14, 2006, which claims priority to Spanish Patent Application No. ES P200500613 filed on Mar. 16, 2005.

TECHNICAL SCOPE

The invention relates to enhancements or improvements of systems for the forced waving of flags.

Currently, within the scope of advertising techniques advertising devices such as flags, small flags, banners and similar items are broadly used even indoors where the absence of wind prevents the natural waving of the flag, thus significantly reducing the advertising impact.

PRIOR ART

Document ES-2026772A, registered in the name of the applicant, discloses a device of this type.

The document describes an advertising device consisting of a flag mast, the lower end of which incorporates forced air means in the form of a turbine, while a nozzle is provided at the upper end of such mast to orientate the flow of forced air generated by the turbine located at the lower end, so that a flag or similar device located at the outlet of the nozzle of the upper end is subject to the action of the air flowing from the turbine, thus achieving its forced waving.

One of the drawbacks of this already known embodiment is the location of the forced air turbine at the lower end of the mast since due to the length of such mast and the eventual pneumatic leaks in the way up to the upper end of the mast, high investments in equipment and power are required to guarantee sufficient flow at the outlet of the nozzle, thus guaranteeing at any time the appropriate waving of the flag. Another drawback of this embodiment is the fact that the turbine is the anchoring base of the mast, since as a consequence a costly mechanical and pneumatic coupling is necessary between the outlet of the turbine and the lower end of the mast as a result of the relatively high mechanical loads present.

On the other hand, as disclosed in such document, the forced air flow coming out from the nozzle is not properly distributed to ensure the adequate waving of the flag since this is achieved through the horizontal deflection modules of such nozzle.

Similarly, document DE 3939065 A1, in the name of Reinhardt, discloses a device of this type with a supporting column inside which different groups of tangential fans are arranged, such supporting column comprising groups of longitudinal openings through which air flows to wave a banner hung from a mast perpendicular to the column.

The first drawback of this already known embodiment is that the cross sectional dimensions of the column are excessively large due to the minimum sizes of the tangential fans located inside the column and which are necessary to generate enough power to maintain the waving of the banner sufficiently stable. In any case, the flag is rather a banner since it waves over a mast perpendicular to the supporting column of the fans; with this arrangement it is not possible to maintain a stable waving of a flag hung from a mast parallel to the supporting column since the air flowing through the grids of the column is not free from turbulences and, consequently, it is not possible to achieve a stable waving of the flag.

From the above it stems the need for a system for the forced waving of flags or similar devices that allows to eliminate the drawbacks previously described.

OBJECT OF THE INVENTION

Consequently, the object of this invention is to develop a system of the type described before that allows to eliminate or, at least, to mitigate the inconveniences of the prior art.

This is achieved through a system according to the characteristics of claim 1. Other additional characteristics of the invention are described in the dependent claims.

According to the invention, the system for the forced waving of flags for advertising devices consists of a support for supporting a flag or similar device through a flag waving shaft and for securing the blowing means which release the forced air flows applied to the flag or similar device located over such waving shaft, characterized in that:

- the blowing means are aimed at providing a laminar air flow (S) through their outlets;
- the flag waving shaft lies perpendicularly to the circulation direction of such laminar air flows at an external side of such outlet(s) of the blowing means, but close to such outlet, an area in which such flow is not subject to turbulences.

According to an additional characteristic of the invention, in the system for the forced waving of flags:

- the blowing means consist of a tangential fan with a turbine, the rotating axis of which runs parallel to the waving shaft located between an external careening convex outwards and an interference body with a section concave outwards, the respective free ends of such external careening and of such interference body delimiting the air outlet contained perpendicularly to the direction of the air flow through such outlet; and
- the flag waving shaft lies vertically and parallel to the shaft of the turbine at the external vicinity of the concave section of such interference body.

In such a structure, the external careening (111) and the interference body (112) wholly or partially consist of a transparent material which provides a slender arrangement acceptable from the aesthetic point of view, which is not rejected by the user.

Additionally and to allow the raising of the flag and the adequate maintenance of the waving of the flag, in accordance with the invention, the blowing means and the flag waving shaft are foreseen to relatively move between them, from a position to unfurl the flag with the flag waving shaft in front of the air outlet to an operating or waving position with the flag waving shaft behind and at one of the sides of such air outlet and vice versa.

According to one of the preferred embodiments of the invention, to achieve the movement between the blowing means and the flag waving shaft an inverted C-shaped element is provided which includes the flag waving shaft and such element may rotate around an axis parallel to the shaft of the fan of the blowing means.

According to another embodiment, to achieve such movement between the blowing means and the flag waving shaft, a dihedral-shaped plate is provided which includes the flag waving shaft and which is arranged in order to allow the side rotation around an axis parallel to the flag waving shaft coupled to the upper or lower ends of the blowing means.

Another embodiment allowing the movement of the blowing means and the flag waving shaft is achieved when the blowing means may oscillate around an axis parallel to the flag waving shaft.

Another advantageous embodiment according to the invention is achieved when the blowing means consist of a pair of tangential fans arranged as a tandem with the tangential fans rotating in the opposite direction and their air outlets in parallel, with the flag waving shaft located between the outlet nozzles.

A further advantageous embodiment of the invention is achieved when the blowing means include a group of axial fans located behind the pair of tangential fans that blow an additional air flow between them.

According to another advantageous embodiment of the invention, the pair of tangential fans arranged as a tandem can establish a flow differential between their air outlets.

According to another embodiment of the invention it is foreseen that the blowing means and the flag waving shaft may rotate with respect to the support so that the flag and such blowing means can be orientated to leeward with respect to an existing outdoors wind component.

According to the invention, it is advantageous to configure the support of the blowing means as a tower or column and, in this case, it might also be advantageous that the supporting tower or column is foreseen as a folding element articulated through a ball joint in order to allow a simple operating method.

Also according to the invention it is advantageous to install between the support and the blowing means an element to absorb vibrations.

In order to raise the flag and to maintain its stable waiving it is advantageous according to an additional characteristic to install, in front of the air outlets (110) of the blowing means, deflection means of the flows (115) consisting of oscillating plates perpendicular to the planes of such air outlets thus adequately orientating the relevant air flow from the blowing means. To provide a broader waving to the flag, according to an additional characteristic of the invention, the flag waving shaft is coupled to an oscillating device to wave the flag in a continuous manner while submitting it simultaneously to the air flows.

Also according to an additional characteristic of the invention, the flag consists of a laminar material with a maximum base weight of 70 gr/m2.

Furthermore, according to the invention, the flag is foreseen as a double body flag.

According to an additional embodiment of the invention, several groups of blowing means and flags are foreseen so that several flags can be simultaneously waved.

According to the invention, it could also be advantageous to install lighting means for the flag located at the support.

Another object of the invention is the operating means of a system for the forced waving of flags according to claims 25 and 26.

In accordance with a first operating method, it is advantageous that, at a first stage, the blowing means are not in operation with the flag waving shaft located at a retracted and distant position at a side of the air outlet of such blowing means and, at a second stage, when the blowing means are still not in operation, the flag waving shaft is placed in front of the air outlet and, subsequently at a third stage, the blowing means are activated to generate through the air outlet a flow of air, somewhat turbulent, in order to unfurl the flag and to allow the flag to start waving and, at a fourth stage, with the blowing means still in operation, the flag waving shaft is placed at a retracted position where it lies beside one of the sides of the air outlet.

According to a second method of operation, it could be advantageous, at a first stage, that the blowing means are not in operation and in a position so that the flag waving shaft is located in front of the air outlet and then, at a second stage, the blowing means are activated to generate an air flow to enable the unfurling and rising of the flag 2; subsequently, at a third stage, the flag waving shaft is placed at a retracted position beside one of, the sides of the air outlet where the flag is waving in a stable manner and, finally at a fourth stage, the flag waving shaft is moved again up to the initial position in front of the air outlet; at that time, the blowing means can be stopped.

BRIEF DESCRIPTION OF THE FIGURES

Other characteristics and advantages of the invention will be more clearly appreciated through the following description and by means of the attached figures, related without limitation to the exemplary embodiments, where.

DETAILED DESCRIPTION OF THE PREFERRED EMBODIMENTS

Figure 1:
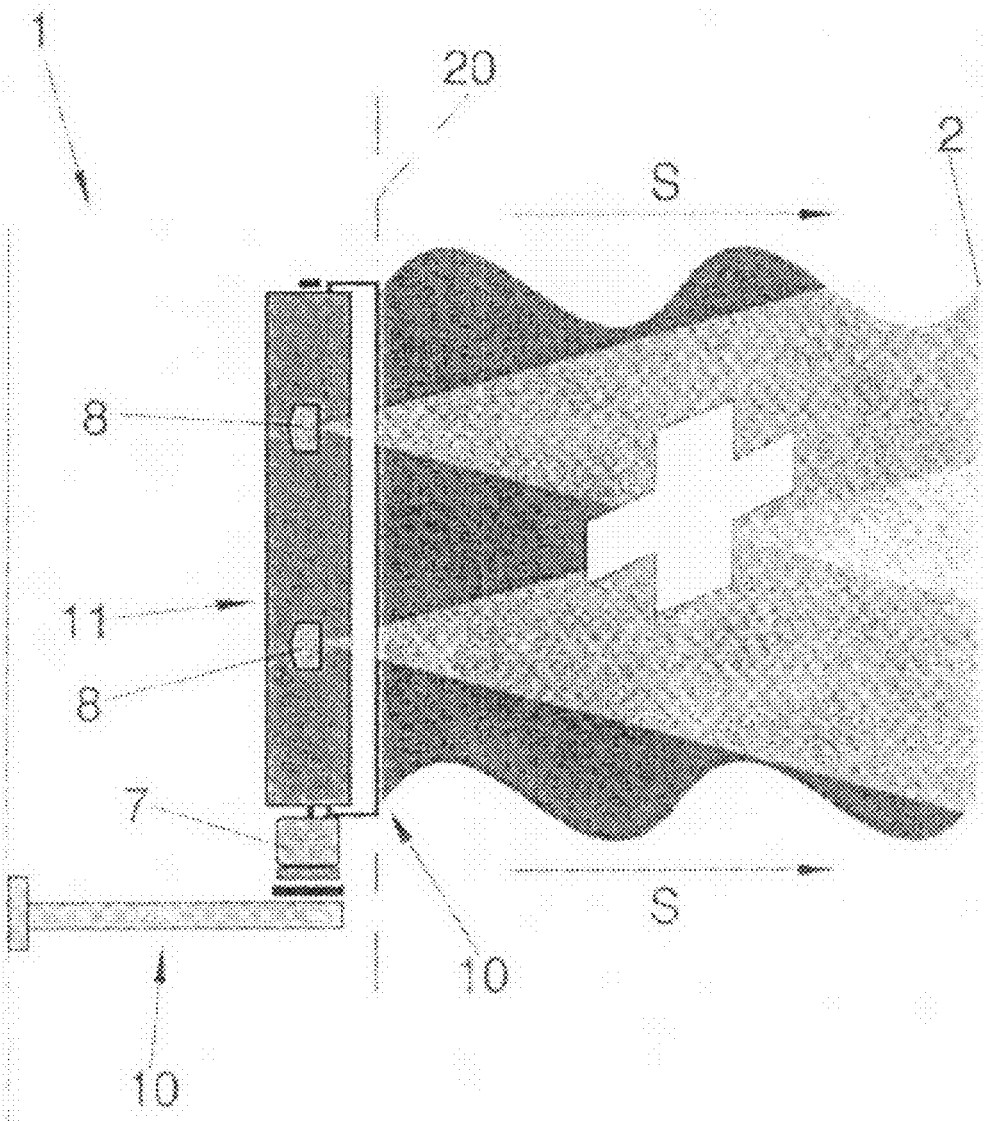
FIG. 1 shows a first diagram of a system for the forced waving of flags and similar devices, according to the invention.

As it can be observed in FIG. 1, the system for the forced waving of flags, in general terms referred to as 1, consists of a support 10, to be anchored to the floor or to the wall, aimed at supporting a flag 2, or similar device through a flag waving shaft 20 and also to support blowing means 11 whose outgoing forced air flow S is applied to the flag or similar device placed on such waving shaft.

Such blowing means 11 provide laminar air flows S through their outlets 110.

As shown in FIG. 1, the flag waving shaft 20 runs perpendicular to the laminar air circulation direction and is positioned at one of the external sides of such outlet of the blowing means but close to them. This way, it allows that the flow that acts on the flag is free from turbulences, thus guaranteeing the stable waving of the flag.

Figure 2A:
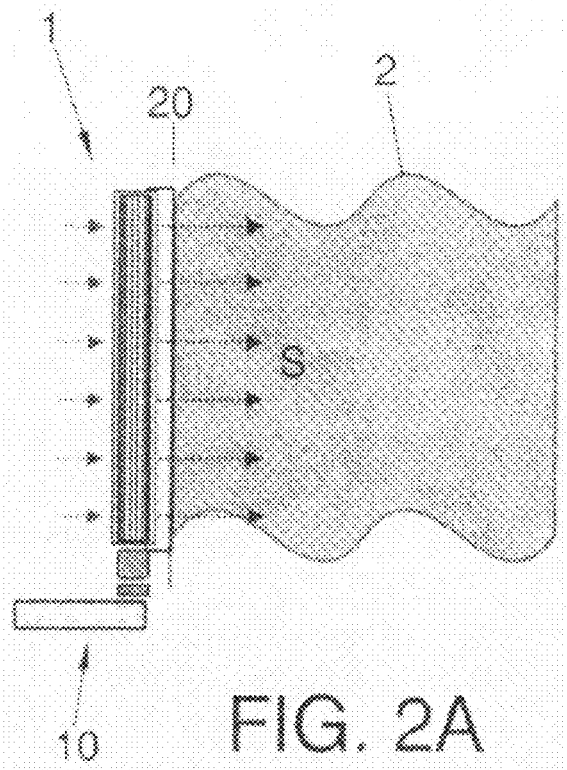
FIGS. 2A to 2C also schematically show respective views of the system in accordance with FIG. 1, with a preferred arrangement of the relevant blowing means.
Figure 2B:
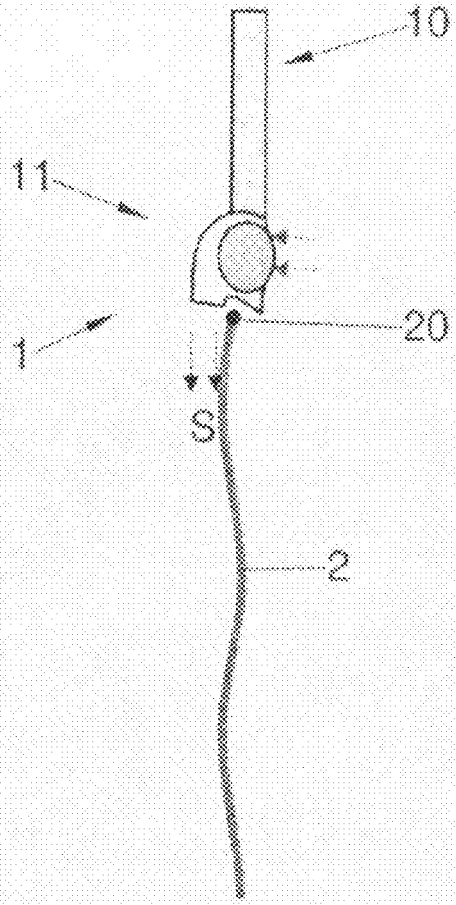
Figure 2C:
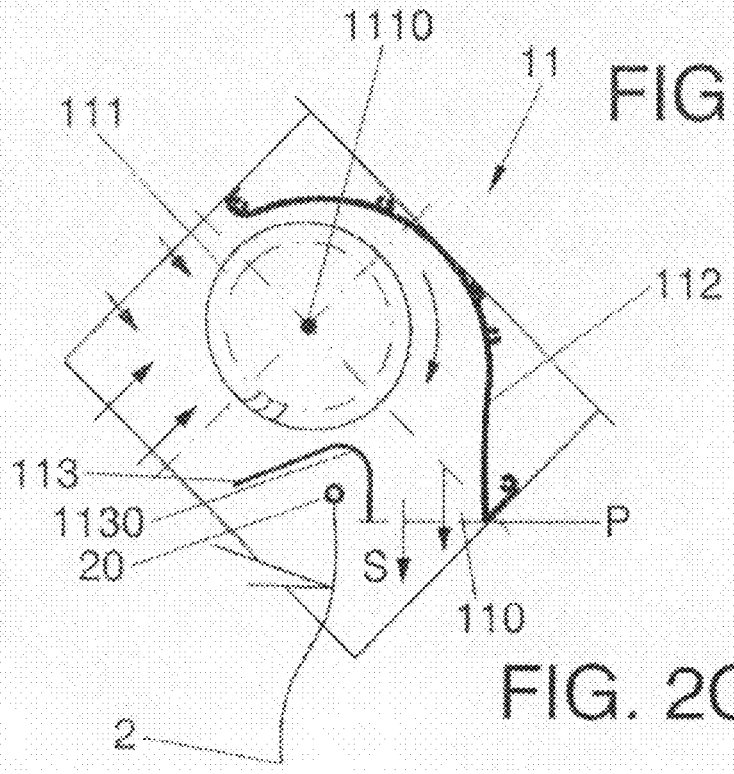
Figure 3:
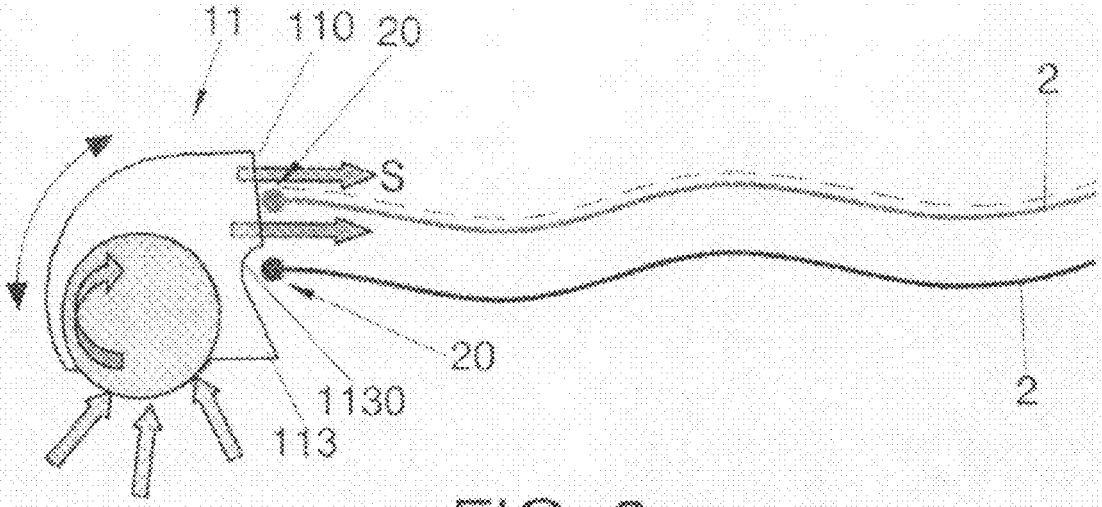
FIG. 3 schematically shows a detail of the layout of the blowing means and the flag shaft to illustrate the relative displacement of the flag waving shaft and the blowing means.

As it can be observed in FIGS. 2A to 2C, the blowing means 11 comprise a tangential fan with a turbine 111, whose rotation axis 1110 runs parallel to the waving shaft 20. Such turbine 11 is arranged between an external careening 112 convex outwards and an interference body 113 with a section 1130 concave outwards so that the respective free ends of such external careening and of such interference body, that delimit the air outlet 110, lay on a plane C perpendicular to the direction of the air flow S through such outlet; additionally, it can be observed that the flag waving shaft 20 lies vertically and parallel to the shaft of the turbine at the external vicinity of the concave section of such interference body. In such a structure, the external careening 112 and the interference body 113 wholly or partially consist of a transparent material such as a plastic appropriate from a technical point of view.

As it can be appreciated in FIGS. 3 to 6B, the possibility of a relative movement between the blowing means 11 and the flag waving shaft 20 has been foreseen between a position to unfurl the flag with the flag waving shaft located in front of the air outlet and an operating or waving position with the flag waving shaft located behind and at one of the sides of such air outlet and vice versa, so that, as it will be explained in more detail hereinafter, the flag 2 is adequately raised and a stable maintenance of the waving is achieved.

Figure 4A:
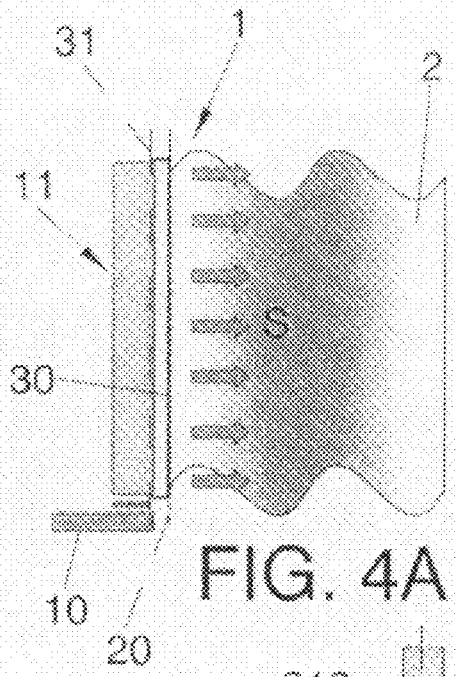
FIGS. 4A and 4B respectively show views of a method of execution to achieve the displacement of the flag waving shaft with respect to the blowing means.
Figure 4B:
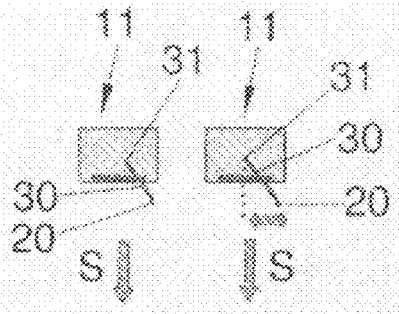
Figure 5A:
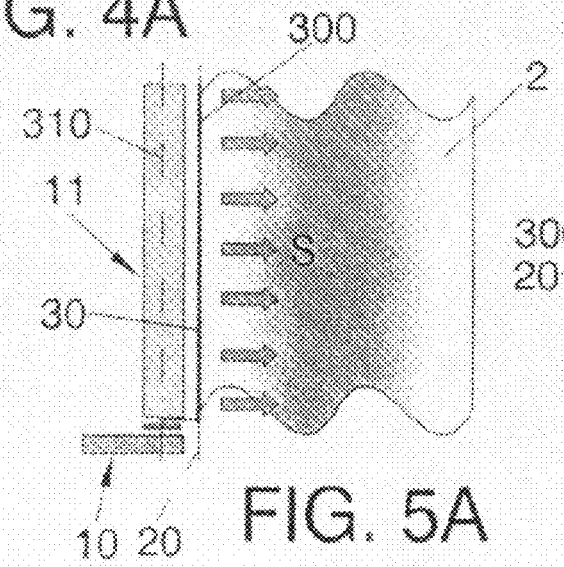
FIGS. 5A and 5B respectively show views of another method of execution for the displacement of the flag waving shaft with respect to the blowing means.
Figure 5B:
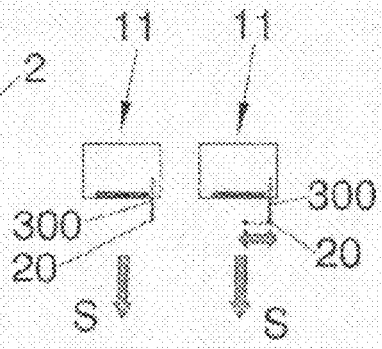

As it is shown in more detail in FIGS. 4A-4B and 5A-5B, it is foreseen that the flag waving shaft is initially moved towards the air outlet 110 of the blowing means 11 in order to be located in front of the turbulent air flow of such area and to achieve an adequate raising of the flag 2, and then to move such flag waving shaft 20 to the operating position just in front of the cavity 1130 of the external careening 113 where the flag will wave in a stable manner since in such area there is a laminar flow without turbulences. This is achieved as shown in FIGS. 4A and 4B by means of an inverted C-shaped element 30 that contains the flag waving shaft 20 able to rotate around the axis 31 parallel to the fan shaft 111 of the blowing means 11; as shown in FIGS. 5A and 5B, by means of a dihedral plate 300 that contains the flag waving shaft 20 which can laterally rotate around a shaft 310 parallel to the flag waving shaft 20, such shaft 310 being coupled to the upper or lower part of the blowing means 11.

Figure 6A:
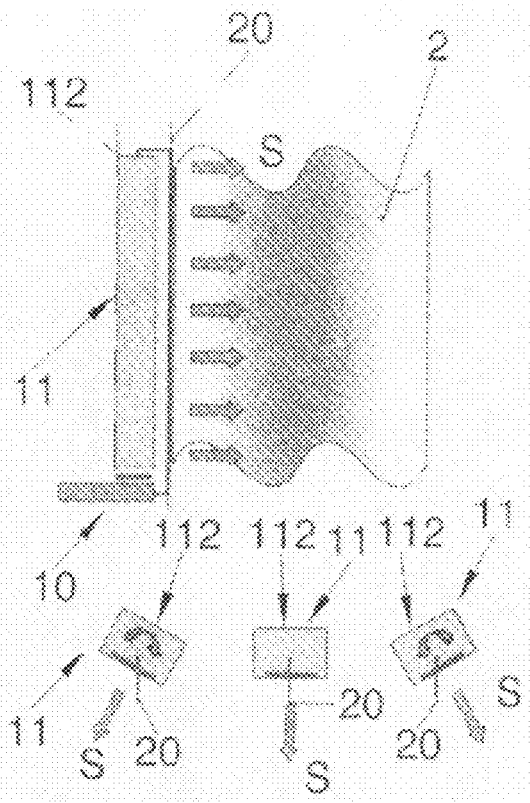
FIGS. 6A and 6B respectively show views of a method of execution for the displacement of the blowing means with respect to the flag waving shaft.
Figure 6B:
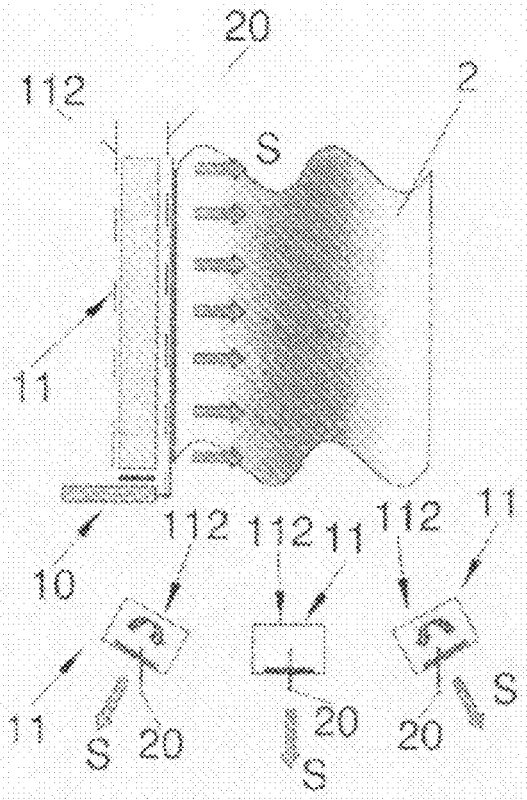
Figure 7:
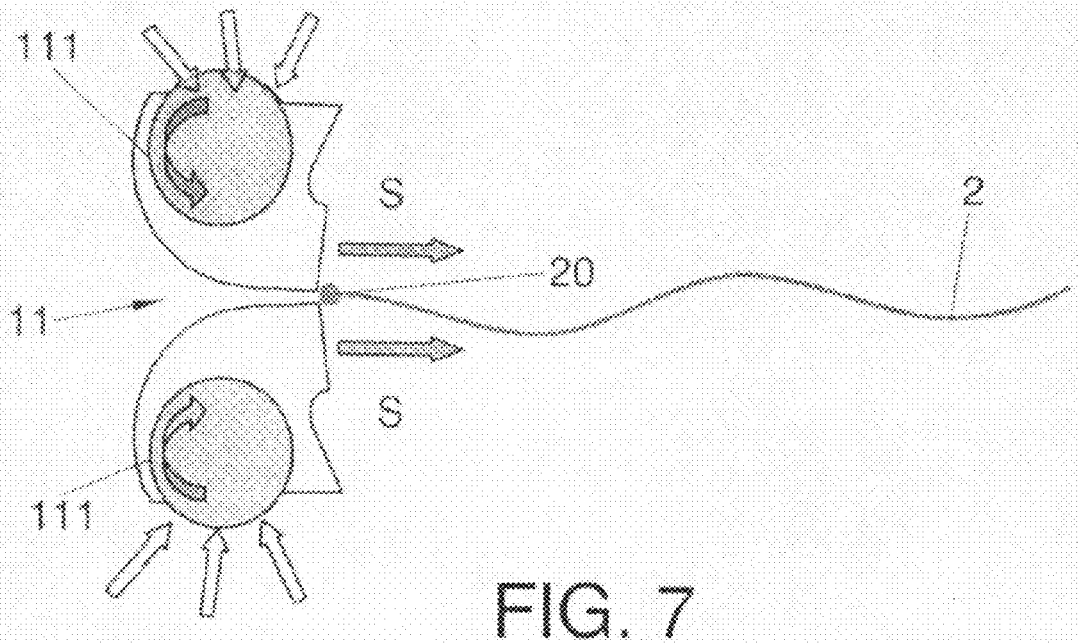
FIGS. 7 to 9 respectively show tandem associations of the blowing means.

However, it is also possible to achieve such relative displacement between the flag waving shaft 20 and the blowing means, as shown in FIGS. 6A and 6B, when the blowing means are foreseen to oscillate around an axis 112 parallel to the flag waving shaft 20.

Figure 8:
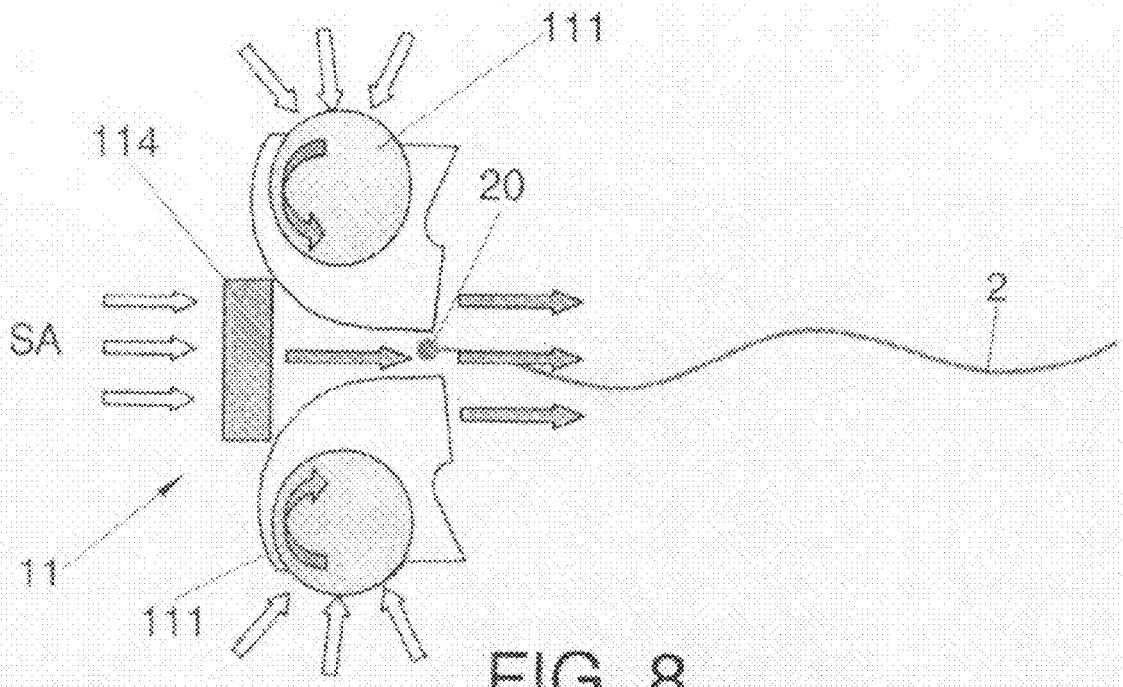

As it can be seen in FIG. 8, according to the invention, the blowing means 11 can be foreseen as a pair of tangential fans 111 arranged as a tandem with the tangential fans rotating in the opposite direction and with the air outlets 110 parallel, the flag waving shaft 20 being arranged between the outlet nozzles. Furthermore, as it can be appreciated in FIG. 8, a set of axial fans 114 can be arranged behind the pair of tangential fans 111 with an additional air flow $S_A$ blowing between them.

Figure 9:
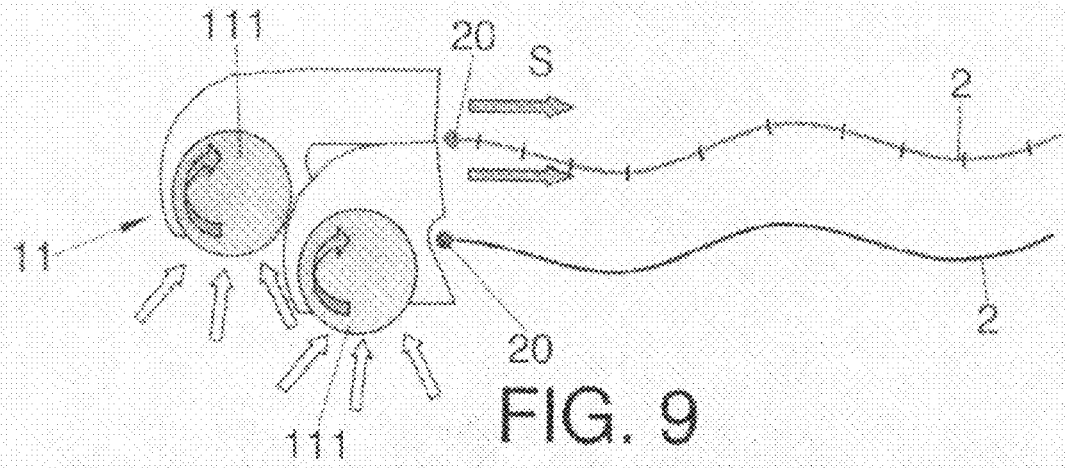

As shown in FIG. 9, another tandem layout of the blowing means 11 is possible through a pair of tangential fans 111 with their parallel air outlets rotating in the same direction, with the flag waving shaft 20 being arranged between the outlet nozzles or in a way to allow it to be displaced between them.

Figure 10:
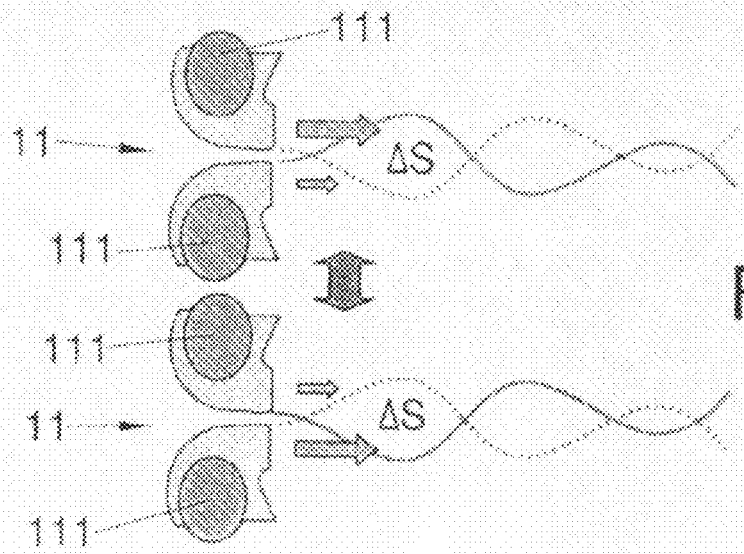
FIG. 10 shows in detail blowing means arranged in tandem to obtain a differential of flow between the streams of both blowing means.

As it can be observed in FIG. 10, in such tandem layout of the blowing means 11, it is possible to establish a flow differential AS between their respective air outlets depending on the air flow blown by each one of the tangential fans 110.

Figure 11:
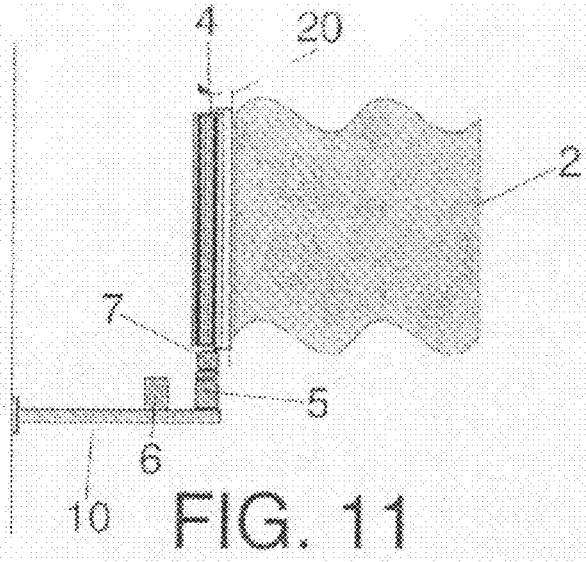
FIG. 11 shows a system, according to the invention, that might be orientated to leeward of a dominant outdoors wind component.
Figure 12A:
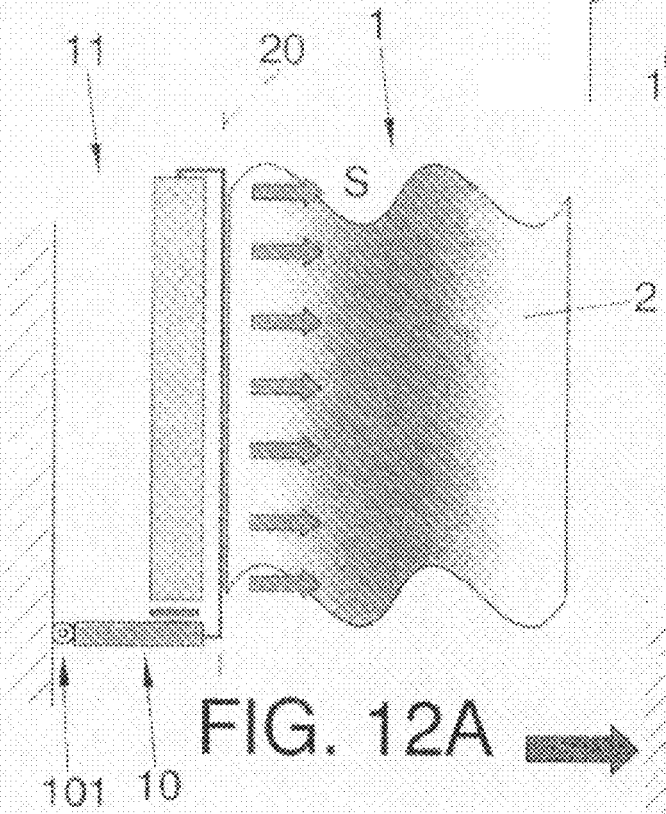
FIGS. 12A to 13B respectively show views to illustrate the operation of a waving system, according to the invention, with a folding arrangement.
Figure 12B:
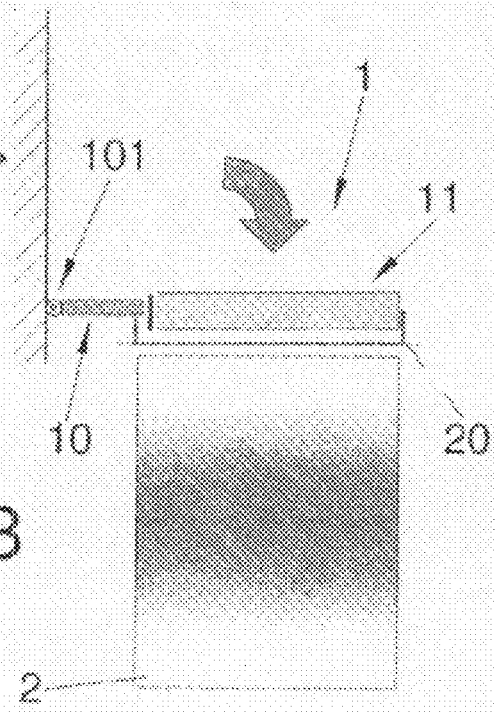
Figure 13A:
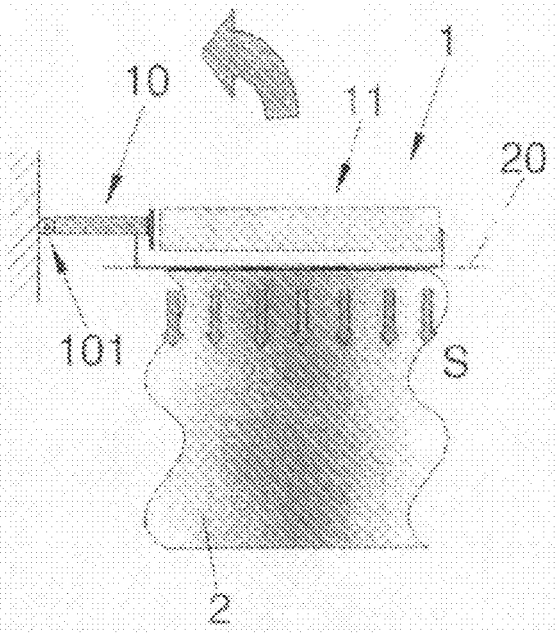
Figure 13B:
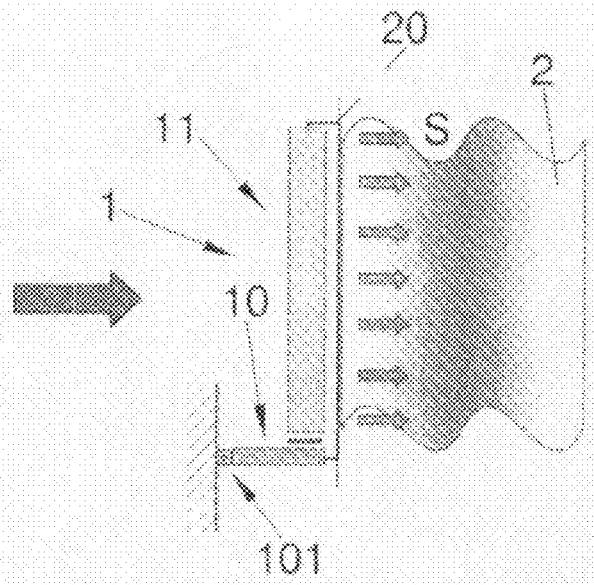
Figure 14A:
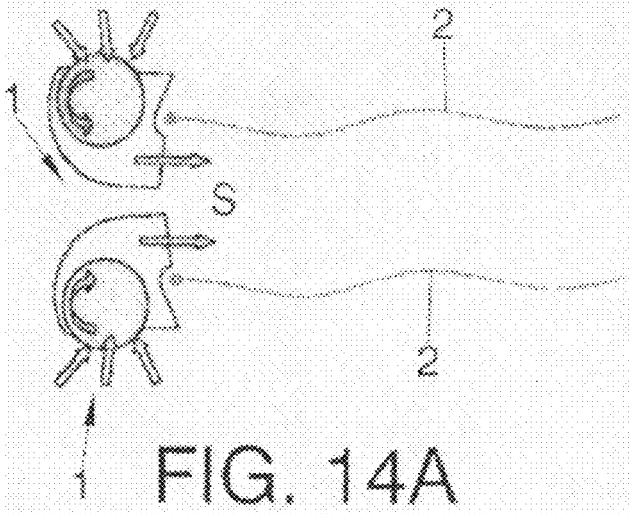
FIGS. 14A and 14B respectively show groups of waving systems to wave several flags.
Figure 14B:
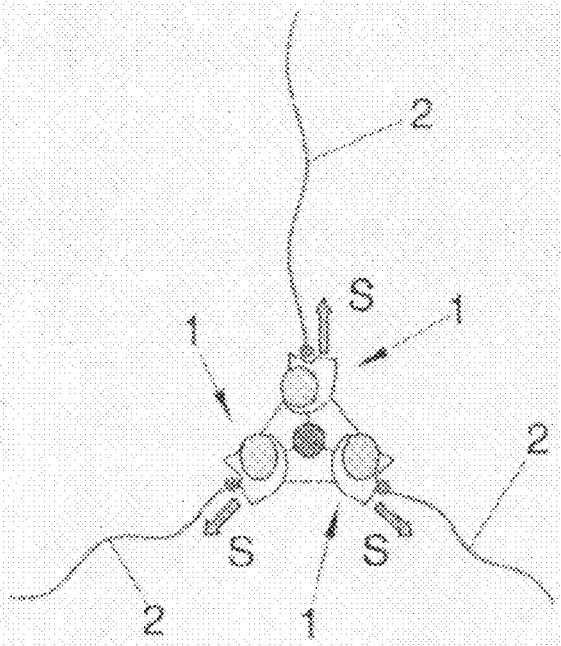

When the system for the flag waving, according to the invention, has to be installed outdoors, it is advantageous, according to the invention, that the blowing means 11 and the flag waving shaft 20 are able to rotate with respect to the support 10 so that the flag 2 and such blowing means can be orientated to leeward with respect to the existing outdoors wind component. As represented in FIG. 11, this can be achieved, for instance, through a weathercock and a pivot 5 where such blowing means 11 are mounted enabling them to rotate; here, within the pivot, driving means, not represented, can be additionally foreseen, that mechanically support the rotation of the weathercock and additionally electronic regulation means 6 can be arranged to control such driving means.

As shown in FIGS. 12A-12B and 13A-13B, the support 10 is foreseen as an articulated folding element through a ball joint 101. Such layout enables the operation of the waving system so that during the start-up and to appropriately raise the flag, the support 10 is folded downwards so that the flag 2 hangs fully extended or unfurled thanks to gravity and after starting up the blowing means to generate the flow that allows the waving of the flag, to elevate the support 10 up to a vertical position where the flag can stably wave.

As it can be seen in FIG. 1, between the support 10 and the blowing means 11 a vibration absorbing element 7 can be installed to reduce the vibrations on the support 10 produced by the blowing means and vice versa. Although this element is not shown in some of the figures, it can be present in any of the embodiments represented in such figures.

Figure 15:
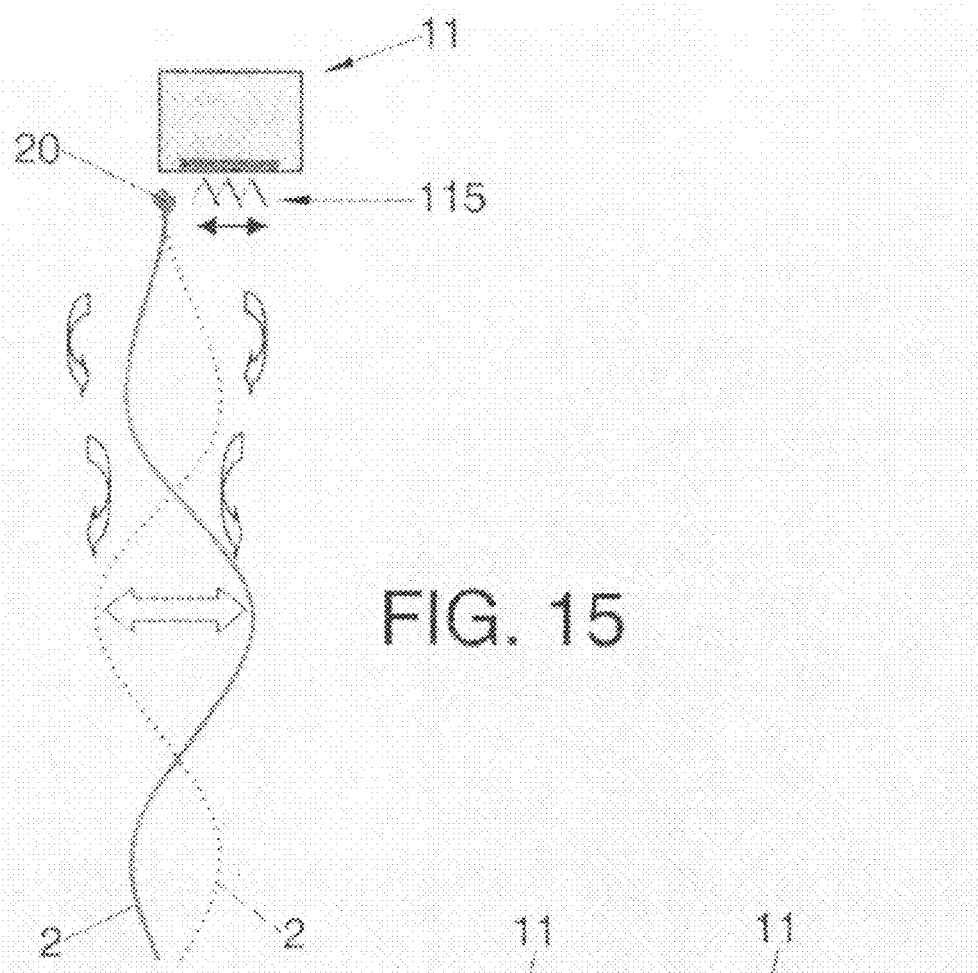
FIG. 15 shows a schematic view of a waving system, according to the invention, with a system of deflection plates to enhance the distribution of the air flow generated by the blowing means.

Referring now to FIG. 15, deflection plates 115 perpendicular to the air outlet are located in front of the air outlet 110 of the blowing means 11 in order to provide means for the deflection of the respective air flow.

Figure 16:
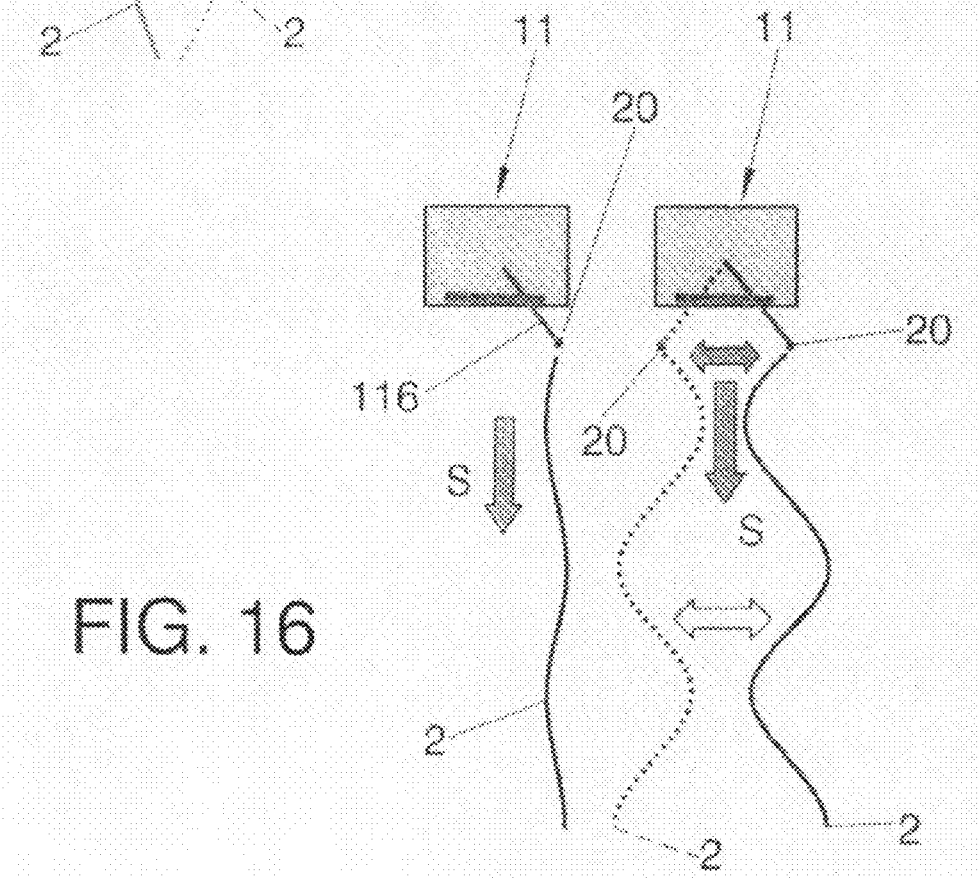
FIG. 16 shows a schematic view of an embodiment of the waving system with a continuous oscillation of the flag waving shaft to produce an increased or expanded waving.

As it can be appreciated in FIG. 16, an oscillating device 116 has been included to discretionally and continuously enable the flag to oscillate while it is subject to the air flows. This allows to increase the waving of the flag which can be necessary for different technical reasons.

According to the invention, an advantageous embodiment is achieved when the flag 2 is made of a laminar material with a maximum base weight of 70 gr/m2; occasionally it is advisable to install a double body flag.

As shown in FIG. 1, in the system for the forced waving of flags according to the invention, it can be advantageous, in order to highlight the advertising message, to incorporate lighting means 8 mounted on the support 10.

Figure 17:
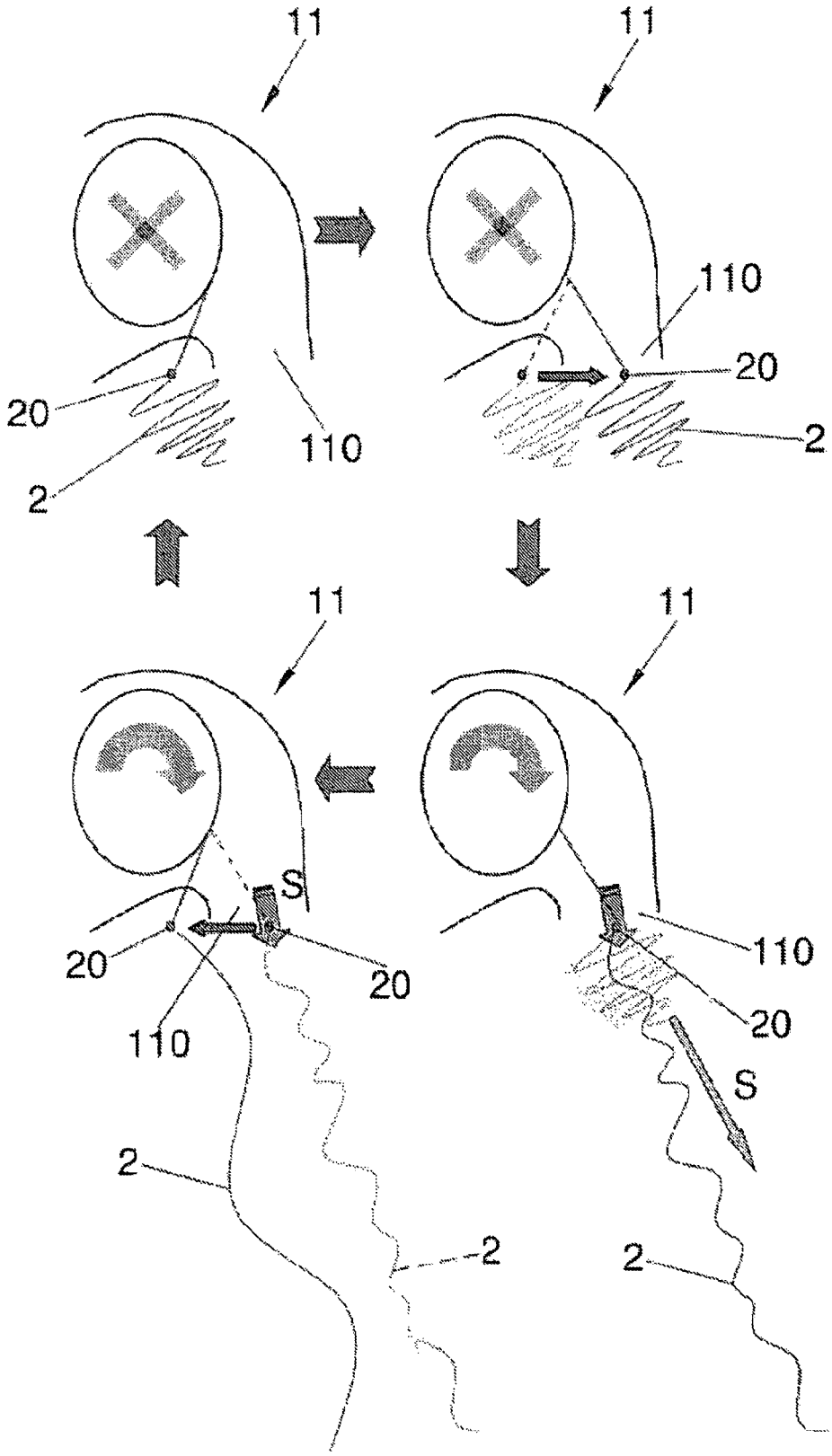
FIGS. 17 and 18 respectively show views that illustrate the methods of operations of the waving system according to the invention.
Figure 18:
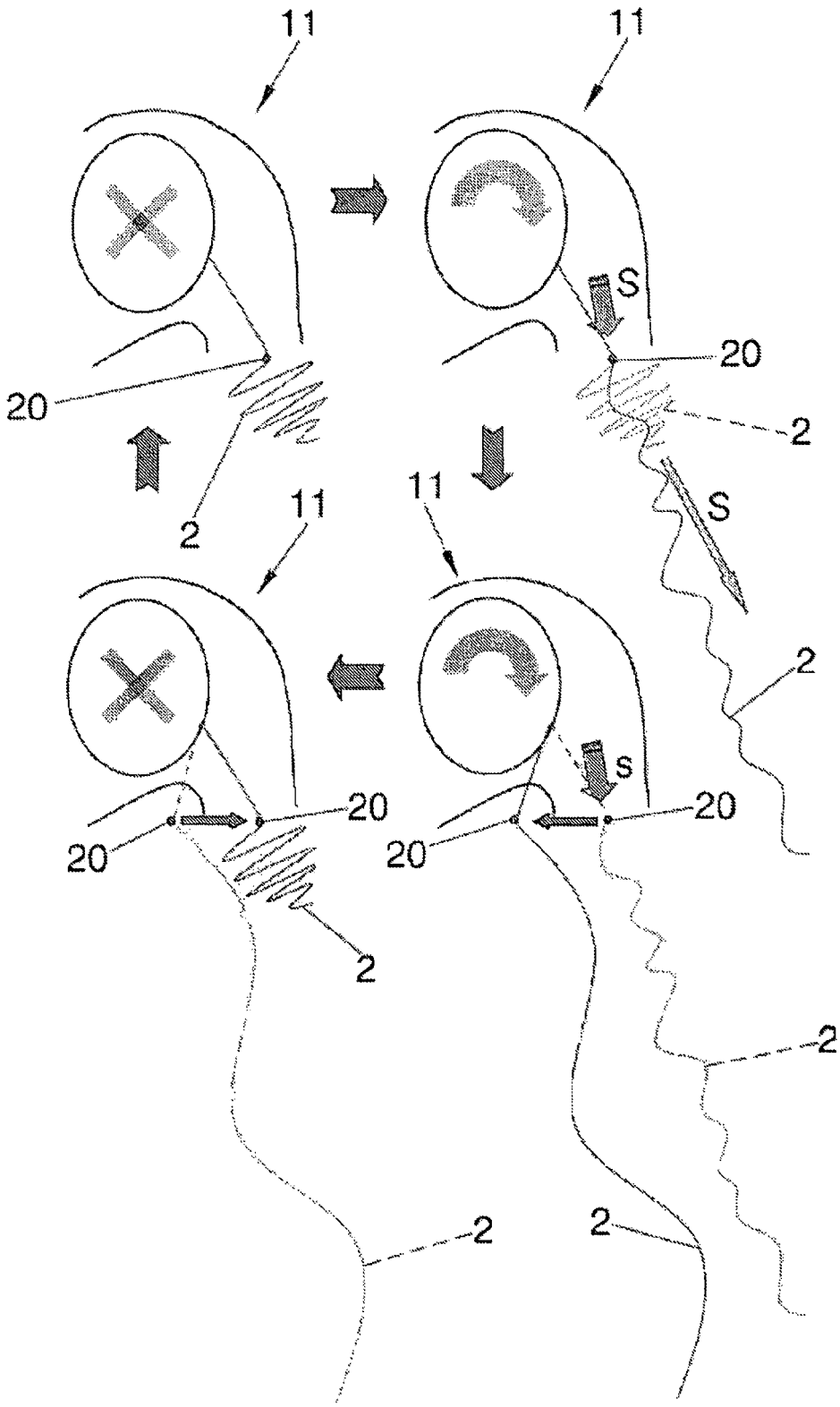

In order to describe the possible operating methods of a system for the forced waving of flags according to the invention, reference will be now made to FIGS. 17 and 18 where it can be observed that the blowing means, when not in operation, are represented by an X, and curved arrows serve to indicate the operation of such blowing means; the successive stages are represented by the relevant straight thick arrows.

FIG. 17 schematically shows the four stages of operation of a first method of operation of the system according to the previous description. At a first stage, the blowing means 11 are not in operation with the flag waving shaft 20 located at a retracted and distant position at a side of the air outlet 110 of such blowing means and, at a second stage, when the blowing means 11 are still not in operation, the flag waving shaft 20 is placed in front of the air outlet 110, the flag 2 remaining static in both positions, hanging from its waving shaft 20. Subsequently at a third stage, the blowing means 11 are activated to generate through the air outlet 110 a flow of air S, somewhat turbulent, in order to unfurl the flag 2 and to allow the flag to start waving and, at a fourth and last stage, with the blowing means 11 still in operation, the flag waving shaft is placed at a retracted position where it lies beside one of the sides of the air outlet 110, where the flow S is of a laminar type without turbulences, which allows the flag 2 to stably wave.

FIG. 18 shows another method of operation. At a first stage, the blowing means are not in operation and in a position so that the flag waving shaft 20 is located in front of the air outlet 110 and then the blowing means 11 are activated to generate an air flow S that owing its turbulent nature enables the fast unfurling and rising of the flag 2; subsequently the flag waving shaft 20 is placed at a retracted position beside one of the sides of the air outlet 110 where the flag is waving in a stable manner due to the laminar flow without turbulences present in that area and, finally, the flag waving shaft is moved again up to the initial position in front of the air outlet 110; at that time, the blowing means are stopped.

The operating methods described before can be implemented by means of control elements such as timers and sequencers or by means of electro-mechanical or electronic elements that can be arranged in the most adequate manner from a technical point of view.

Once the object of the invention has been sufficiently described, it must be stated that any embodiments derived from changes in shape, materials, use of equivalent or similar mechanical elements as well as those resulting from a routine application of what has been disclosed above should be considered included within the scope of the invention, so that the invention will only be limited by the scope of the following claims.

The invention claimed is:

1. A system for the forced waving of flags for advertising and similar devices comprising a support to support a flag or similar item through a flag waving shaft and also for securing blowing means which release forced air flows that are applied to the flag or a similar element placed on the waving shaft, wherein:

the blowing means provide through their outlet laminar air flows; and the flag waving shaft is positioned perpendicularly to the direction of flow of the laminar air flows on an external side of, and close to the outlets of the blowing means, said zone containing flows with no turbulence;

and wherein the blowing means comprise a tangential fan with a turbine whose rotation axis runs parallel the flag waving shaft positioned between an external careening convex outwards and an interference body with a section concave outwards, the respective free ends of such external careening and of such interference body delimiting such air outlet contained in a plane perpendicular to the direction of the air flow through such outlet; and the flag waving shaft lies vertically parallel to the turbine axis in the outer vicinity of the concave section of such interference body.

2. A system for the forced waving of flags according to claim 1, wherein the external careening and the interference body comprise a transparent material.

3. A system for the forced waving of flags according to claim 1, wherein the blowing means and the flag waving shaft move relatively between them, from a position to unfurl the flag with the flag waving shaft in front of the air outlet to an operating or waving position with the flag waving shaft behind and at one of the sides of such air outlet and vice versa.

4. A system for the forced waving of flags according to claim 3, wherein an inverted C-shaped element is provided which includes the flag waving shaft and such element may rotate around an axis parallel to the shaft of the fan of the blowing means.

5. A system for the forced waving of flags according to claim 3, wherein a dihedral-shaped plate is provided which includes the flag waving shaft and which is arranged in order to allow the side rotation around an axis parallel to the flag waving shaft and whose shaft is coupled to the upper or lower ends of the blowing means.

6. A system for the forced waving of flags according to claim 3, wherein the blowing means oscillate around an axis parallel to the flag waving shaft.

7. A system for the forced waving of flags according to claim 1, wherein the blowing means comprise a pair of tangential fans arranged as a tandem with the tangential fans rotating in the opposite direction and the air outlets in parallel, with the flag waving shaft located between the outlet nozzles.

8. A system for the forced waving of flags according to claim 1, wherein the blowing means include a group of axial fans located behind the pair of tangential fans that blow an additional air flow between them.

9. A system for the forced waving of flags according to claim 1, wherein the blowing means comprise a pair of tangential fans arranged as a diagonal tandem with their air outlets parallel, and the tangential fans rotating in the same direction and with the flag waving shaft positioned between the outlet nozzles.

10. A system for the forced waving of flags according to claim 1, wherein the pair of tangential fans establish a flow differential between their respective air outlets.

11. A system for the forced waving of flags according to claim 1, wherein the blowing means and the flag waving shaft are able to rotate with respect to the support so that the flag and such blowing means can be orientated to leeward with respect to the existing outdoors wind component.

12. A system for the forced waving of flags according to claim 11, wherein in order to be orientate to leeward with respect to an outdoors wind component a weathercock and a pivot are foreseen where such blowing means are mounted in such a way to enable them to rotate.

13. A system for the forced waving of flags according to claim 12, further comprising driving means within the pivot that mechanically support the rotation of the weathercock as well as electronic regulation means to control such driving means.

14. A system for the forced waving of flags according to claim 1, wherein the support and the blowing means is a tower or a column.

15. A system for the forced waving of flags according to claim 14, wherein the support tower or column comprises an articulated folding element through a ball joint.

16. A system for the forced waving of flags according to claim 1, wherein between the support and the blowing means there is a vibration absorbing element.

17. A system for the forced waving of flags according to claim 1, wherein in front of the air outlet of the blowing means there are deflection means of the flows comprising oscillating plates perpendicular to the plane of such air outlet.

18. A system for the forced waving of flags according to claim 1, wherein the flag waving shaft is coupled to an oscillating device to continuously enable the flag to oscillate while it is subject to the air flows.

19. A system for the forced waving of flags according to claim 1, wherein the flag is made of a laminar material with a maximum base weight of 70 gr/m2.

20. A system for the forced waving of flags according to claim 1, characterized in that the flag is a double body flag.

21. A system for the forced waving of flags according to claim 1, wherein there are several groups of blowing means and flags whereby several flags may be waved simultaneously.

22. A system for the forced waving of flags according to claim 1, further comprising lighting means for the flag, mounted on the support.

23. A method of operation of a system for the forced waving of flags according to claim 1, wherein:

the blowing means are not in operation with the flag waving shaft located at a retracted and distant position at a side of the air outlet of such blowing means; subsequently when the blowing means are still not in operation, the flag waving shaft is placed in front of the air outlet; subsequently the blowing means are activated to generate through the air outlet a flow of air, somewhat turbulent, in order to unfurl the flag and to allow the flag to start waving; and with the blowing means still in operation, the flag waving shaft is placed at a retracted position where it lies beside one of the sides of the air outlet.

24. A method of operation of a system for the forced waving of flags according to claim 1, wherein:

the blowing means are not in operation and in a position so that the flag waving shaft is located in front of the air outlet; subsequently the blowing means are activated to generate an air flow that enables the unfurling and rising of the flag 2; subsequently the flag waving shaft is placed at a retracted position beside one of the sides of the air outlet where the flag is waving in a stable manner; and finally the flag waving shaft is moved again up to the initial position in front of the air outlet; at that time, the blowing means are stopped.

* * * * *